US005320574A

United States Patent [19]

Lahr et al.

[11] Patent Number: 5,320,574

[45] Date of Patent: Jun. 14, 1994

[54] TOY VEHICLE WITH STEERABLE WHEELS

[75] Inventors: Robert Lahr, Las Vegas, Nev.; Barry Lynch, Princes Risborough, England

[73] Assignee: Ideal Loisirs, Paris, France

[21] Appl. No.: 30,060

[22] PCT Filed: Jul. 9, 1992

[86] PCT No.: PCT/FR92/00658

§ 371 Date: Mar. 19, 1993

§ 102(e) Date: Mar. 19, 1993

[87] PCT Pub. No.: WO93/02761

PCT Pub. Date: Feb. 18, 1993

[30] Foreign Application Priority Data

Jul. 31, 1991 [FR] France ..... 91 09744

[51] Int. Cl.[5] ..... A63H 17/36

[52] U.S. Cl. ..... 446/460; 446/443

[58] Field of Search ..... 446/468, 444; 273/86 B

[56] References Cited

U.S. PATENT DOCUMENTS

| | | | |
|---|---|---|---|
| 3,027,682 | 4/1962 | Schlau | 446/460 |
| 3,590,526 | 7/1971 | Deyerl | 446/460 |
| 3,635,304 | 1/1972 | Hills | 446/468 X |
| 4,156,987 | 6/1979 | Lahr | 446/460 |
| 4,755,161 | 7/1988 | Yang | 446/460 X |

FOREIGN PATENT DOCUMENTS

| | | | |
|---|---|---|---|
| 0307658 | 3/1989 | European Pat. Off. . | |
| 2722734 | 11/1978 | Fed. Rep. of Germany | 446/460 |
| 2486410 | 1/1982 | France . | |
| 52-24904 | 7/1977 | Japan | 446/460 |
| 1196142 | 6/1970 | United Kingdom . | |
| 8302351 | 7/1983 | World Int. Prop. O. . | |

*Primary Examiner*—Mickey Yu

*Attorney, Agent, or Firm*—Griffin, Butler, Whisenhunt & Kurtossy

[57] ABSTRACT

A toy vehicle with a chassis (1), a pair of non-steerable wheels (2) and a pair of steerable wheels (3) mounted on the chassis, a reversible motor (4) mounted on the chassis and fitted with a first outlet shaft (5) associated with a transmission (6) for driving at least one of the non-steerable wheels in a forward direction regardless of the direction of rotation of the motor, and with a second outlet shaft (14) carrying at least one control tooth (15). The steerable wheels are mounted on supports (7) that are pivoted to the chassis about respective substantially vertical axes (8) and are interconnected by a tie-bar (11). A steering control stud (13) is carried by the tie-bar (11) and faces the second outlet shaft (14) and extends parallel thereto.

3 Claims, 1 Drawing Sheet

TOY VEHICLE WITH STEERABLE WHEELS

Figure 1:
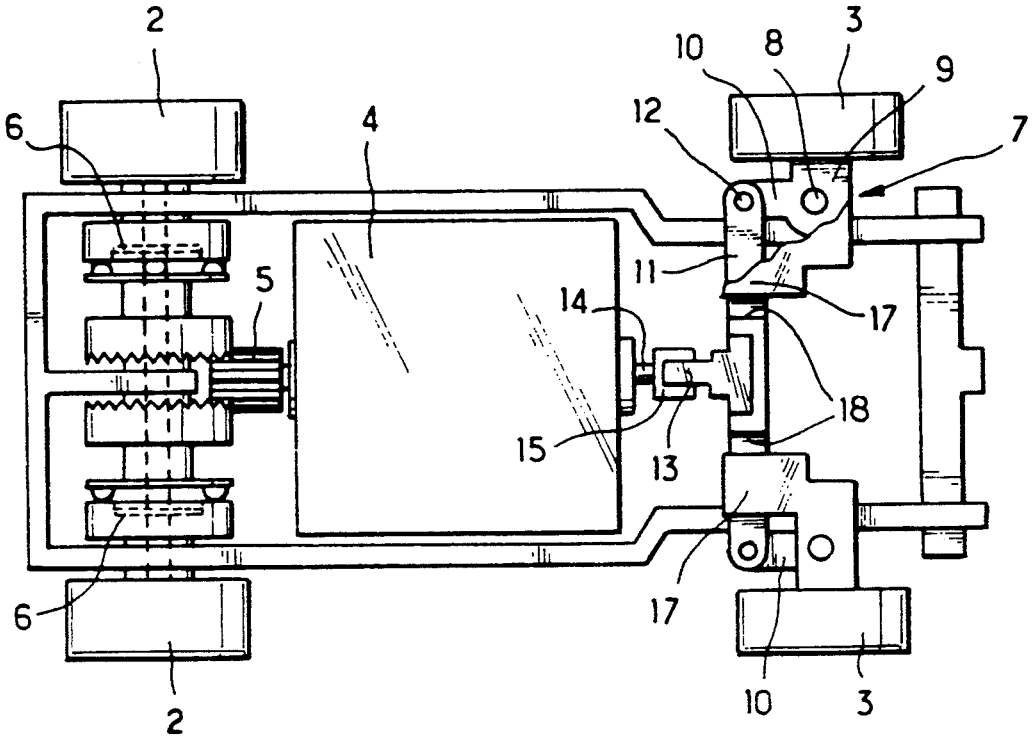

The present invention relates to a toy vehicle.

A toy vehicle is known, in particular from Document US-A-4 156 987, that comprises a chassis, a pair of non-steerable wheels, and a pair of steerable wheels mounted on the chassis, a reversible motor mounted on the chassis and fitted with a first outlet shaft associated with a transmission for driving the non-steerable wheels in a forwards direction regardless of the direction of rotation of the motor, and with a second outlet shaft carrying a steering control member for the steerable wheels, the steerable wheels being mounted on supports which are pivoted to the chassis about respective substantially vertical axes, and which are interconnected by a tie-bar.

In the above-mentioned document, the control member comprises a friction sleeve mounted on the second outlet shaft of the motor and co-operating with a plate pivoted on the vehicle chassis about an axis that is substantially vertical and that is also pivoted to the tie-bar. The plate extends beneath the friction sleeve to be driven thereby to the right or to the left depending on the direction of rotation of the motor. The capacity of a device of that type to steer the steerable wheels is linked to the amount of friction that the friction sleeve exerts on the steering control plate. This degree of friction is very difficult to adjust and it has a direct effect on the general behavior of the vehicle. If the degree of friction is high, then the steering control plate is driven appropriately each time the direction of rotation of the motor reverses, however the motor is then braked each time it changes direction, thereby causing the vehicle to loose speed. In contrast, if the degree of friction is insufficient, then the vehicle is not braked, but the steerable wheels are not caused to steer adequately.

In existing devices, the friction sleeve has been replaced by a control gear wheel that includes a series of teeth and the steering control plate for the steerable wheels includes a stud that co-operates with the control gear wheel. However, because of the oscillating movements of the control plate, the control stud does not remain parallel to the second outlet shaft and it sometimes happens that the control stud escapes from the teeth of the controlling gear wheel when the motor reverses its direction of rotation, and as a result the steerable wheels do not always change direction appropriately.

An object of the invention is to propose a vehicle that includes a control member that systematically ensures that the steerable wheels change direction when the direction of rotation of the motor is reversed, while minimizing the extent to which the motor is slowed down at the moment it changes direction.

To achieve this object, the present invention provides a toy vehicle comprising a chassis, a pair of non-steerable wheels and a pair of steerable wheels mounted on the chassis, a reversible motor mounted on the chassis and fitted with a first outlet shaft associated with a transmission for driving at least one of the non-steerable wheels in a forwards direction regardless of the direction of rotation of the motor, and with a second outlet shaft carrying a steering control member for the steerable wheels, the steerable wheels being mounted on supports which are pivoted to the chassis about respective substantially vertical axes and which are interconnected by a tie-bar, wherein the control member includes at least one control tooth carried by the second outlet shaft of the motor, and wherein a steering control stud is carried by the tie-bar facing the second outlet shaft and extending parallel thereto.

Thus, when the direction of rotation of the motor is reversed, the control tooth carried by the second outlet shaft of the motor comes into contact over its entire length with the control stud carried by the tie-bar, and positive engagement is ensured for changing the direction of the steerable wheels.

In an advantageous version of the invention, the control stud is triangular in section having an edge directed towards the second outlet shaft of the motor. Thus, while ensuring positive contact between the control stud and the control tooth, friction between these two elements is minimized and consequently slowdowns in the speed of rotation of the motor are also minimized.

In another advantageous aspect of the invention, the chassis includes steering abutments overlying the tie-bar, and the tie-bar includes projecting shoulders for engaging the steering abutments. Thus, each time the direction of rotation of the motor is reversed, one of shoulders on the tie-bar comes into contact with one of the steering abutments overlying the tie-bar, thereby ensuring that the steerable wheels are positioned with great accuracy.

Figure 2:
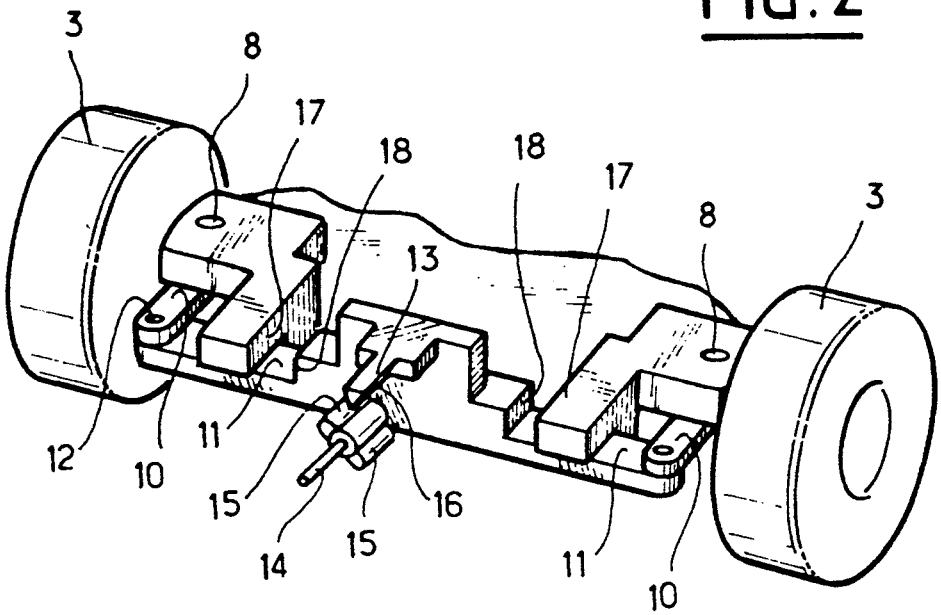

Other characteristics and advantages of the invention appear on reading the following description of a particular, non-limiting embodiment of the invention given with reference to the accompanying drawing, in which:

FIG. 1 is a partially cutaway plan view of a toy vehicle of the invention, with the bodywork of the vehicle being removed; and FIG. 2 is a perspective view on a larger scale of the front portion of the toy vehicle of the invention.

With reference to the figures, the toy vehicle of the invention comprises a chassis 1, a pair of non-steerable wheels 2 mounted at the rear of the chassis, and a pair of steerable wheels 3 mounted at the front of the chassis. A reversible motor 4 is mounted on the mid-portion of the chassis and it is powered via contacts (not shown) projecting from the bottom face of the chassis to rub against power supply lines carried by a circuit that is also not shown. The reversible motor 4 has a first outlet shaft 5 carrying a toothed wheel that is engaged in conventional manner with transmission means 6 associated with the non-steerable wheels in order to drive them in a forwards direction regardless of the direction in which the motor is rotating.

The steerable wheels 3 are carried on L-shaped supports 7 that are hinged to the chassis about substantially vertical axes 8. One branch 9 of each of the L-shaped supports 7 extends out from the chassis and carries one of the steerable wheels 3, while the other branch 10 of the L-shaped support extends substantially in the longitudinal direction of the vehicle towards the rear thereof. The branches 10 of the steerable wheel supports are interconnected by a tie-bar 11 which is hinged to the branches 7 of the steerable wheel supports about substantially vertical hinge axes 12. In its middle portion, the tie-bar 11 carries a control stud 13 which extends rearwards over a second outlet shaft 14 of the reversible motor 4, and parallel thereto. The second outlet shaft 14 carries two steering control teeth 15 which are symmetrically disposed about the outlet shaft 14 such that the weight of the control teeth 15 is balanced about the outlet shaft 14 and does not interfere with the operation of the reversible motor 4 even when it is rotating at very great speed. The control stud 13 is naturally at a distance from the second outlet shaft 14 such that, when the motor 4 rotates, the teeth 15 bear against the control stud 13 and urge it to the right or to the left depending on the direction in which the motor 4 is rotating.

In the preferred embodiment as illustrated, the control stud 13 is triangular in section and includes an edge 16 that faces towards the second outlet shaft 14. Thus, positive contact is ensured between one of the teeth 15 and the control stud 13 each time the direction of rotation of the motor 4 reverses, while nevertheless minimizing friction between the teeth 15 and the control stud 13.

In addition, the chassis includes steering abutments 17 that overlie the tie-bar 11, and said bar includes projecting shoulders 18 for engaging the steering abutments 17. Thus, each time the direction of rotation of the motor 4 reverses, the tie-bar 11 is pushed until one of its shoulders 18 comes into contact with one of the steering abutments 17, such that the position of the tie-bar 11 and consequently the amount of steer applied to the steerable wheels 3 is determined with great accuracy.

Naturally, the invention is not limited to the embodiment described, and variant embodiments may be devised without going beyond the ambit of the invention. In particular, although the control stud 13 in the embodiment described is disposed above the second outlet shaft 14, it is possible to have the control member 13 extending beneath the second outlet shaft 14. Placing the control stud above the second outlet shaft is nevertheless preferred since that makes it easier for the control stud 13 to escape should the steerable wheels 3 be jammed by a foreign body, thereby avoiding excessive wear of the control teeth 15 or of the control stud 13.

Although the tie-bar 11 has been shown behind the pivot axes 8 of the steerable wheel supports, the tie-bar could be disposed in front of said pivot axes. It would also be possible to provide a second outlet shaft that is fitted with more than two teeth, e.g. with a gear having six teeth.

We claim:

1. In a toy vehicle having a chassis (1), a pair of non-steerable wheels (2) and a pair of steerable wheels (3) mounted on the chassis, a reversible motor (4) mounted on the chassis and fitted with a first outlet shaft (5) associated with a transmission (6) for driving at least one of the non-steerable wheels (2) in a forward direction regardless of the direction of rotation of the motor and with a second outlet shaft (14) carrying a steering control member for the steerable wheels, the steerable wheels (3) being mounted on supports (7) which are pivoted to the chassis about respective substantially vertical axes (8) and which are interconnected by a tie-bar (11), the improvement comprising a control member having two teeth (15) carried by the second outlet shaft (14) of the motor (4) and disposed symmetrically about the second outlet shaft (14), and a single steering control stud (13) is carried by the tie-bar (11) such that the stud faces the second outlet shaft and extends parallel thereto.

2. A toy vehicle according to claim 1, wherein the control stud (13) is triangular in section, and has an edge (16) facing towards the second outlet shaft (14).

3. A toy vehicle according to claim 1, wherein the chassis includes steering abutments (17) overlying the tie-bar (11) and the tie-bar includes projecting shoulders (18) for engaging the steering abutments (17).

* * * * *